United States Patent [19]

O'Rourke et al.

[11] 4,136,467

[45] Jan. 30, 1979

[54] MEANS AND METHOD FOR IMPARTING STABILIZATION ERROR TO THE LINE OF SIGHT OF A SIMULATOR

[75] Inventors: John D. O'Rourke, Utica; Stuart W. Flockencier, Mt. Clemens, both of Mich.

[73] Assignee: Chrysler Corporation, Highland Park, Mich.

[21] Appl. No.: 808,210

[22] Filed: Jun. 20, 1977

[51] Int. Cl.[2] ..... F41F 27/00; G09B 9/00

[52] U.S. Cl. ..... 35/25

[58] Field of Search ..... 35/11 R, 12 P, 12 S, 35/25

[56] References Cited

U.S. PATENT DOCUMENTS

| | | | |
|---|---|---|---|
| 3,283,418 | 11/1966 | Brewer et al. | 35/11 R |
| 3,484,951 | 12/1969 | Menzel | 35/11 R |
| 3,538,624 | 11/1970 | Minnich et al. | 35/12 P |
| 3,608,212 | 9/1971 | Lenneryd et al. | 35/25 |
| 3,795,065 | 3/1974 | Aubert et al. | 35/25 |

*Primary Examiner*—William H. Grieb

*Attorney, Agent, or Firm*—Baldwin & Newtson

[57] ABSTRACT

In a preferred embodiment a fire control combat simulator contains a real time record of stabilization error experienced by the line-of-sight of the fire control combat system being simulated such as a stablized gun on the hull of a tank. A number of methods of making a real time record of stabilization error are disclosed.

12 Claims, 3 Drawing Figures

Elevation
50
Elev. Noise
54
Elev. Filter
58
60
Elev. Pos.
Azm. Pos.
Time
Azimuth
52
Azm. Noise
56
Azm. Filter
Magnetic Tape
Random Noise Inputs
Stab. Error Power Spectral Density
32
34
K
30
38
Target Maneuvers
36
48
42
Gunner
Handles & Stab. Shaping Networks
44
46
CRT Display
40
Electronics, Processing And Output Panel
Visual Data Of Target Position
Background
Target 50

MEANS AND METHOD FOR IMPARTING STABILIZATION ERROR TO THE LINE OF SIGHT OF A SIMULATOR

BACKGROUND AND SUMMARY OF THE INVENTION

The present invention pertains to novel means and method for a simulator which has a line of sight which the user of the simulator must place on a target and is more specifically concerned with introducing stabilization error into the line of sight of the simulator so that realistic simulation is obtained.

Fire control combat simulators simulate the operation of fire control combat systems. They may be used to evaluate the effectiveness of a fire control combat system and/or the user. Moreover, they are especially useful as training devices, permitting the user to obtain practice without the necessity of going out into the field. This can mean a significant savings because fuel and ammunition are conserved and wear and tear on equipment is minimized.

One type of fire control combat system utilizes a stabilization system which stabilizes the weapon and tracking system (while in motion) about the tracking coordinates. An example of this type system is a tank having a stabilization system for the tank gun and sights which provides a stable line of sight to the target. This enables the gunner to acquire and engage targets while traversing rough terrain. However, due to inherent system limitations the stabilization system is incapable of maintaining a perfect alignment during severe terrain disturbances. The stabilization error is a function of the particular stabilization system design and the disturbances introduced to the gun and sight through hull motions over the terrain which the tank is traversing. The gunner's task is to lay the sight reticle on the target and maintain the reticle on target, although both the target and tank are moving relative to one another; acquire the range to the target; and fire the gun.

Insofar as applicants are aware, prior simulators for simulating a fire control combat system suffer from one or more deficiencies. At one extreme the simulators are crude, utilizing clay models of the terrain which are engaged by cam followers (for example see U.S. Pat. Nos. 3,608,212 or 3,283,418). At another extreme, simulation is so complex in an attempt to achieve realistic simulation that the cost of the simulator becomes large thereby eroding the savings in actual system usage which are intended to be banked by using the simulator. For example, a large expensive digital computer may be programmed with many complicated equations representing the hull, stabilization and terrain characteristics and requiring solution in real time for imparting the intended simulation to the simulator. Necessarily, the computer is tied up on a full time basis with the simulator while the latter is being used.

The present invention is directed toward a novel means and method for a fire control combat simulator which offer less complication, less expense, more realistic simulation and greater versatility. With the present invention it is unnecessary to tie up a large computer whenever the simulator is put to use. Moreover, the simulator can be compactly constructed because it does not have accompanying models of terrain or large displays. Its lower cost means that the simulator can be deployed more extensively, giving more practice time to more gunners. Yet even with the foregoing advantages, realistic simulation is attained so that skill levels attained by users of the simulator will be consistent with requirements of actual combat situations.

The foregoing features, advantages, and benefits, along with additional ones, will be seen in the ensuing description and claims which are to be considered in conjunction with the accompanying drawings.

DETAILED DESCRIPTION OF THE INVENTION

Figure 1:
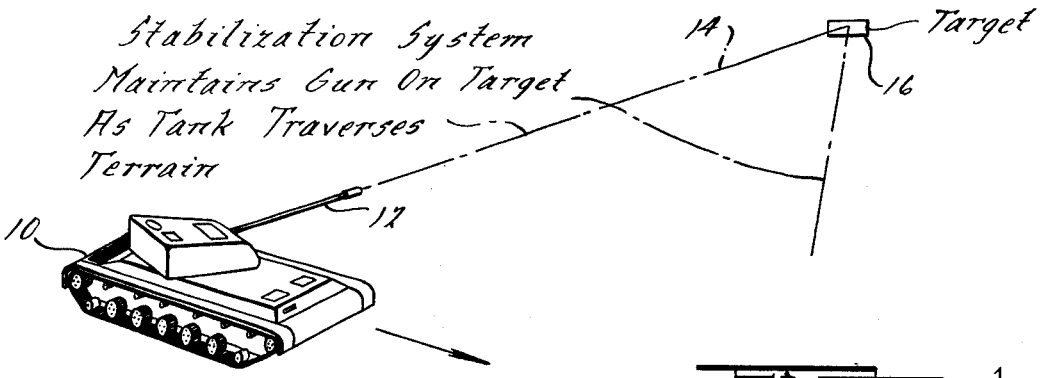
FIG. 1 is a perspective view illustrating an actual fire control combat system having a stabilized line of sight for the gun.

In FIG. 1 there is disclosed an exemplary fire control combat system having a stabilized line-of-sight for the gun. The system comprises a tank 10 having a turret-mounted gun 12 mounted on the hull of the tank. Included in the tank is a stabilization system which stabilizes the line-of-sight 14 of gun 12 on a target 16 once the target has been acquired by the gunner inside the tank. The stabilization system maintains line-of-sight 14 on the target even while the tank is in motion. Details of the stabilization system are unimportant insofar as the present invention is concerned and, therefore, should be considered as would be used in any known type of stabilization system. Regardless of what stabilization system is used, it can at best only approximately hold the line-of-sight on the target when the tank is in motion due to disturbances to which the tank is subjected while in motion over terrain. It is incumbent upon the gunner to actually place the sight exactly on the acquired target in order to properly aim the gun for scoring a target hit. With the tank in motion over terrain, the hull is subjected typically to gross input disturbances which adversely affect the line-of-sight. The stabilization system generally compensates for these gross input disturbances to maintain the line-of-sight at least approximately on the target. However, a remnant stabilization error remains. This stabilization error is a function of the terrain, the hull and the stabilization response characteristics. The present invention is concerned with real time generation of such stabilization error in a simulator.

Figure 2:
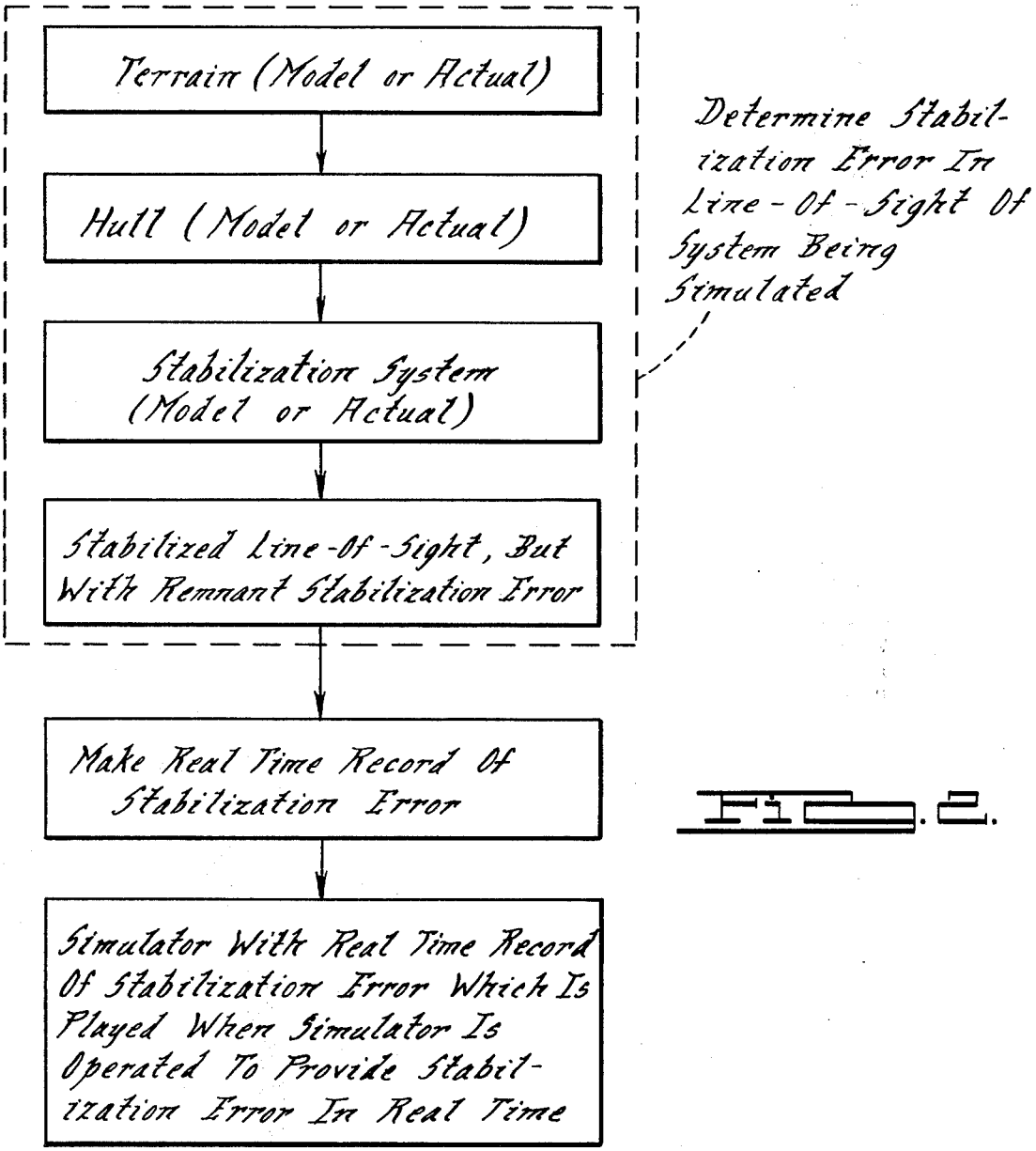
FIG. 2 is a diagram illustrating the method of the present invention in block diagrammatic form.

FIG. 2 illustrates one method of generating stabilization error in a simulator in accordance with principles of the present invention. Briefly, the method comprises determining the stabilization error of the line of sight in the system being simulated, making a real time record of the stabilization error and playing the record in the simulator to impart the stabilization error to the line-of-sight of the simulator. One way of determining the stabilization error is in the time domain; one specific technique is to actually measure it in a moving tank. From this measurement a real time record for use in the simulator is made. Details of FIG. 2 illustrate other methods. The gross disturbances which are input to the stabilization system are a function of both the terrain characteristics over which the tank operates and the hull characteristics for a given tank design. These characteristics can be obtained either empirically by test data acquired in an actual system operating over a given terrain or can be obtained by mathematical modeling.

(It should be pointed out that it is not essential to obtain the actual terrain characteristic per se apart from the hull characteristic, although such can be done if desired). Furthermore, the characteristics can be obtained either in the frequency domain or in the time domain. In any event the input to the stabilization system does represent the gross input disturbances to which the line-of-sight would be subjected absent the stabilization system. The stabilization system characteristics are also obtained, here again, either by actual empirical data derived from testing a given stabilization system or by a mathematical modeling technique. The response characteristic of the stabilization system will be such that the gross input disturbances to which the line-of-sight would otherwise be subjected are substantially compensated for, so that only a stabilization error remains. One way of describing the stabilization error is by means of power spectral density techniques in the frequency domain as given by the following equation.

$$\phi_{STAB}(w) = [H(iw)]^2 \phi_{HULL}(w) \qquad \text{Eq. (1)}$$

Where $\phi_{HULL}(w)$ = power spectra of the hull disturbance

H(iw) = stabilization system closed-loop transfer function and $\phi_{STAB}(w)$ = the output remnant power spectra of the stabilization system.

(note: the hull response is a function of both the hull design and the terrain over which the tank operates.)

The stabilization error can now be utilized to make a real time record of stabilization error which simulates, both in frequency and amplitude content, the actual stabilization error experienced by the stabilized line-of-sight in the actual system. A statistically accurate representation of actual error both in frequency and amplitude content (but not necessarily phase content) is obtained by this procedure. When a real time record of the simulated error is played in a simulator, the user of the simulator cannot discern any difference from what he would see as the gunner in the tank fire control system.

A significant advantage of the present invention is that relatively simple hardware can be utilized to implement the real time generation of stabilization error; in contrast, other types of procedures are more complicated and/or require more complex and costly equipment, yet provide no better simulation. Indeed, attempts to program large digital computers so as to try to provide real time solutions of complex equations may be doomed to failure since the computers may not be able to carry out the multitudinous computations fast enough to accurately generate the stabilization error in real time.

Figure 3:
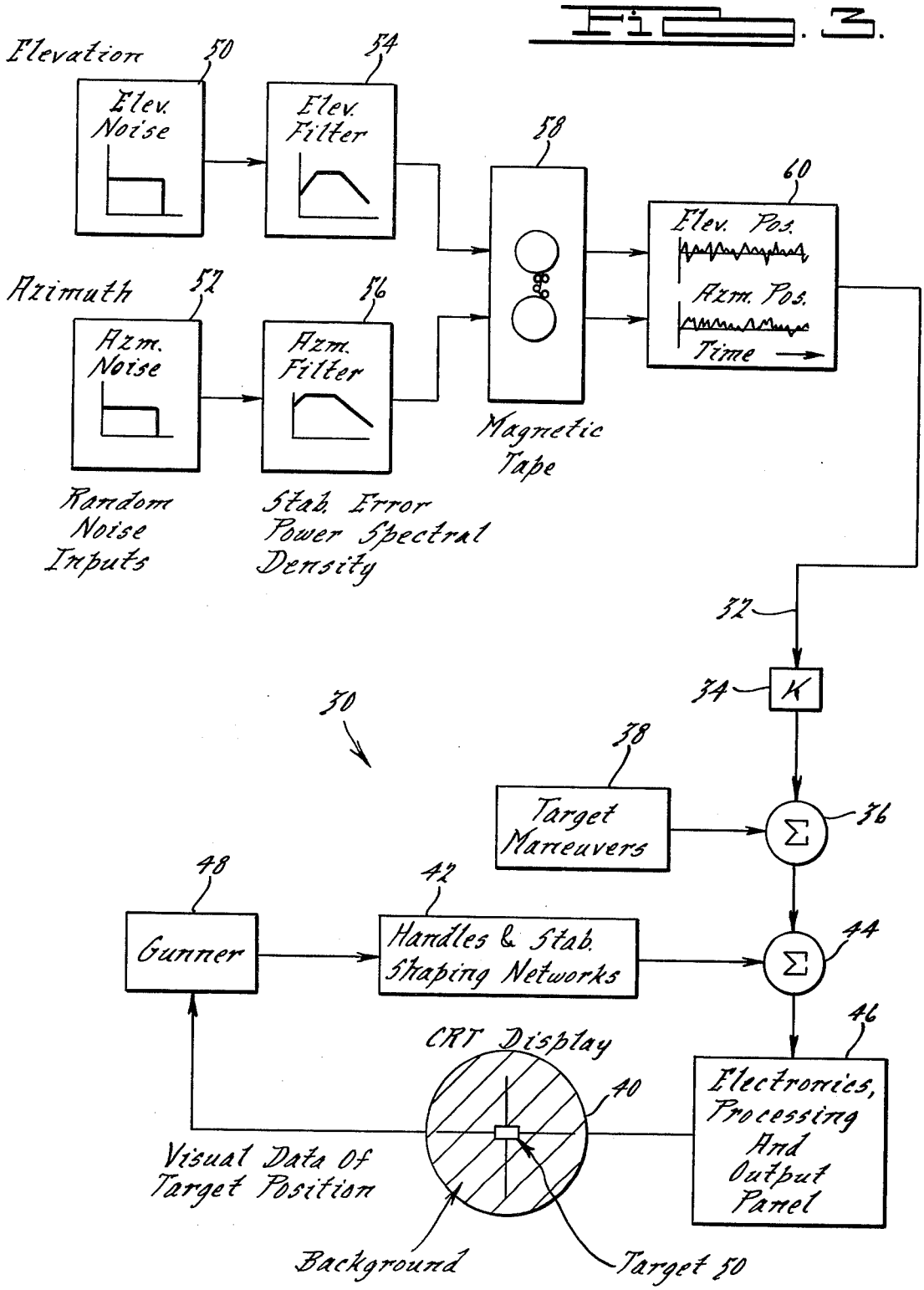
FIG. 3 is a block diagram of one embodiment of a simulator system incorporating principles of the present invention.

FIG. 3 illustrates one example of a simulator including a system for developing stabilization error according to the present invention. The FIG. 3 example is for a two dimensional coordinate system wherein elevation and azimuth stabilization errors are generated for a simulator. There is disclosed a simulator 30 which comprises: an input 32 at which simulated elevation and azimuth stabilization errors are received; gain circuitry 34 for scaling the errors; a summing junction 36; means for introducing targets maneuvers 38; a CRT display 40 for displaying the line-of-sight (defined by the cross-hairs) in relation to the target; gunner control handle and stabilization shaping networks, shown generally at 42, simulating the actual gun control system for enabling the gunner to align the cross-hairs with the target; a further summing junction 44; and electronic processing and output panel 46 for the CRT display. The gunner 48 is also shown as part of the closed-loop system. Briefly, the gunner 48, the handles and stabilization shaping networks 42, the summing junction 44, the electronic processing and output panel 46, and the CRT display 40 form a closed loop system whereby the gunner manipulates the handles to place the cross-hairs on the target. (It should be pointed out here that details of this portion of the simulator are merely exemplary.) The target maneuvers 38 as well as the stabilization error are in the nature of external disturbances introduced into the closed loop. The target maneuvers may be utilized to move the target on the CRT display in a manner which would simulate actual movement of a target, for example on a battlefield. The stabilization errors are simulating the elevation and azimuth disturbances which would actually appear to the gunner in an actual tank traveling over a given terrain. Because the line-of-sight is fixed, the stabilization error is also input to the target on the CRT whereby the target will be displaced relative to the line of sight.

In FIG. 3 an analog system is disclosed for developing the simulated elevation and azimuth disturbances and comprises a pair of random noise generators 50 and 52 for elevation and azimuth respectively, a pair of filters 54 and 56 for elevation and azimuth respectively, and a magnetic tape recorder and player 58. The random noise generators 50 and 52 are conventional devices which generate random noise signals (i.e., white noise).

The filters 54 and 56 are constructed using conventional filter synthesis techniques to approximate the frequency response characteristic for each channel respectively in accordance with the frequency response characteristic of the stabilization error which is obtained in the manner described in connection with FIG. 2. The random noise input in each channel is coupled through the corresponding filter to develop in real time stabilization errors as indicated at 60 in FIG. 3. These may be initially recorded on recorder and player 58 and later played back as input signals supplied to the input 32.

A digital system can also be used wherein the real time record of stabilization error is stored in memory and is output in real time to the simulator.

A simulator utilizing the present invention is particularly useful for a number of purposes. For one, a given stabilization system design may be evaluated by utilizing a variety of men and tracking tasks to obtain a statistical average of the system performance. Based on the results of this testing, the stabilization system and/or the hull system may be refined further to improve upon any features which may need betterment. A further usage is in training gunners in a realistic situation without the necessity of actually firing live ammunition and utilizing firing ranges. Therefore, the invention is seen to provide a useful and novel means and method for both training and evaluation purposes which is economical and accurate.

What is claimed is:

1. For a simulator which simulates the view of a target, provides for movement of the target in the field of view, and has a line of sight which the user of the simulator must place on the target, the method of more realistically simulating in the simulator a system having a stabilized line of sight by introducing the stabilization error which the stabilized line of sight in the system being simulated experiences comprising: determining the stabilization error in the line of sight of the system being simulated in response to disturbances; making a real time record of the stabilization error; and when the simulator is in use, playing the record and imparting the real time stabilization error contained therein to the line of sight of the simulator while also imparting target maneuvers to the target of the simulator.

2. The method set forth in claim 1 wherein the line of sight of the simulator is fixed with respect to the view of the user and the real time stabilization error is imparted to the target of the simulator.

3. The method set forth in claim 1 wherein the stabilization error is determined by actual test data obtained from an operative embodiment of the system being simulated.

4. The method set forth in claim 1 wherein the stabilization error is determined by mathematical modeling of the system being simulated.

5. The method set forth in claim 1 wherein the stabilization error is determined by determining the response characteristic of the unstabilized system to disturbances, determining the response characteristic of the stabilization system and determining the stabilization error from said two response characteristics.

6. The method set forth in claim 5 wherein at least one of said two response characteristics is obtained by mathematical modeling.

7. The method set forth in claim 5 wherein said two response characteristics are determined in the frequency domain.

8. The method set forth in claim 5 wherein said two response characteristics are determined in the time domain.

9. The method set forth in claim 1 wherein said stabilization error is determined in the time domain.

10. The method set forth in claim 9 wherein the record is made in real time from said stabilization error by synthesizing a filter which approximates the stabilization error power spectral density and passing random noise through said filter.

11. The method set forth in claim 1 wherein the stabilization error is obtained for two dimensions.

12. In a simulator which simulates the view of a target, provides for movement of the target in the field of view, and has a stabilized line of sight which the user of the simulator must place on the target but which is subject to stabilization error, the improvement comprising: a real time record of the stabilization error in the line of sight of the system being simulated in response to disturbances; means for playing the record while the simulator is in use; and means for imparting the real time stabilization error contained in the record to the line of sight of the simulator while the simulator is in use; and means for also imparting target maneuvers to the target of the simulator while the simulator is in use.

* * * * *